US008485517B2

(12) United States Patent
Clark et al.

(10) Patent No.: US 8,485,517 B2
(45) Date of Patent: Jul. 16, 2013

(54) METHOD AND APPARATUS FOR FEEDING SHEETS OF MEDIA FROM A MEDIA STACK IN AN IMAGE PRODUCTION DEVICE

(75) Inventors: Robert Alan Clark, Williamson, NY (US); Zhigang Fan, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 100 days.

(21) Appl. No.: 12/850,887

(22) Filed: Aug. 5, 2010

(65) Prior Publication Data

US 2010/0298971 A1 Nov. 25, 2010

Related U.S. Application Data

(63) Continuation-in-part of application No. 12/187,930, filed on Aug. 7, 2008, now Pat. No. 7,770,887.

(51) Int. Cl.
*B65H 3/46* (2006.01)

(52) U.S. Cl.
USPC ..... 271/105

(58) Field of Classification Search
USPC ..... 271/97, 98, 105; 414/795.5; 382/112, 382/141
See application file for complete search history.

(56) References Cited

U.S. PATENT DOCUMENTS

| | | | | |
|---|---|---|---|---|
| 4,397,459 | A | 8/1983 | Silverberg et al. | |
| 5,048,813 | A | 9/1991 | Wierszewski et al. | |
| 5,098,077 | A | 3/1992 | Russel | |
| 5,290,023 | A | 3/1994 | Sasaki et al. | |
| 5,356,127 | A | 10/1994 | Moore et al. | |
| 5,984,622 | A * | 11/1999 | Schum et al. | 271/97 |
| 6,264,188 | B1 | 7/2001 | Taylor et al. | |
| 6,279,896 | B1 | 8/2001 | Linder et al. | |
| 6,726,200 | B2 | 4/2004 | Gohl et al. | |
| 7,575,231 | B2 | 8/2009 | Sasaki et al. | |
| 2004/0100013 | A1 | 5/2004 | Mathewson | |
| 2005/0040584 | A1 | 2/2005 | Isemura | |
| 2006/0175746 | A1 | 8/2006 | Adachi | |
| 2007/0069446 | A1 | 3/2007 | Lamendola et al. | |
| 2007/0080491 | A1 * | 4/2007 | Suga et al. | 271/97 |
| 2007/0262513 | A1 | 11/2007 | Fukusaka | |
| 2010/0117290 | A1 * | 5/2010 | Izumichi | 271/11 |

FOREIGN PATENT DOCUMENTS

JP 05306045 A 11/1993

OTHER PUBLICATIONS

AMIS-710600-A8: 600dpi CIS Module Data Sheet; AMI Semiconductor; Jul. 6, 2008.

* cited by examiner

*Primary Examiner* — Jeremy R Severson
(74) *Attorney, Agent, or Firm* — Ronald E. Prass, Jr.; Prass LLP

(57) ABSTRACT

A method and apparatus for feeding sheets of media from a media stack in an image production device is disclosed. The method may include fluffing a stack of media with a predetermined amount of air flow, sensing a number of fluffed media sheets in the media stack, determining if the number of fluffed media sheets equals or exceeds a predetermined value, wherein if it is determined that the number of fluffed media sheets equals or exceeds the predetermined value, feeding the fluffed media sheets to an image production section of the image production device.

21 Claims, 4 Drawing Sheets

METHOD AND APPARATUS FOR FEEDING SHEETS OF MEDIA FROM A MEDIA STACK IN AN IMAGE PRODUCTION DEVICE

PRIORITY INFORMATION

This application claims priority as a continuation-in-part of U.S. patent application Ser. No. 12/187,930, filed Aug. 7, 2008, the content of which is incorporated herein by reference in its entirety.

BACKGROUND

Disclosed herein is a method for feeding sheets of media from a media stack in an image production device, as well as corresponding apparatus and computer-readable medium.

One of the more challenging aspects of high speed vacuum corrugated feeder technology is assuring the reliable separation of individual sheets of media away from the media stack. This process is initiated via the use of a media fluffing system. The conventional approach is to spend considerable time developing a media fluffing system which is robust enough to handle in an open-loop fashion all sheets of media within the product specification. Since there is no conventional method for gauging the effectiveness of the media fluffing system in real time, it can take several months to a couple of year's worth of testing to refine the fluffing system to assure reliable feeder operation.

SUMMARY

A method and apparatus for feeding sheets of media from a media stack in an image production device is disclosed. The method may include fluffing a stack of media with a predetermined amount of air flow, sensing a number of fluffed media sheets in the media stack, determining if the number of fluffed media sheets equals or exceeds a predetermined value, wherein if it is determined that the number of fluffed media sheets equals or exceeds the predetermined value, feeding the fluffed media sheets to an image production section of the image production device.

DETAILED DESCRIPTION

Figure 1:
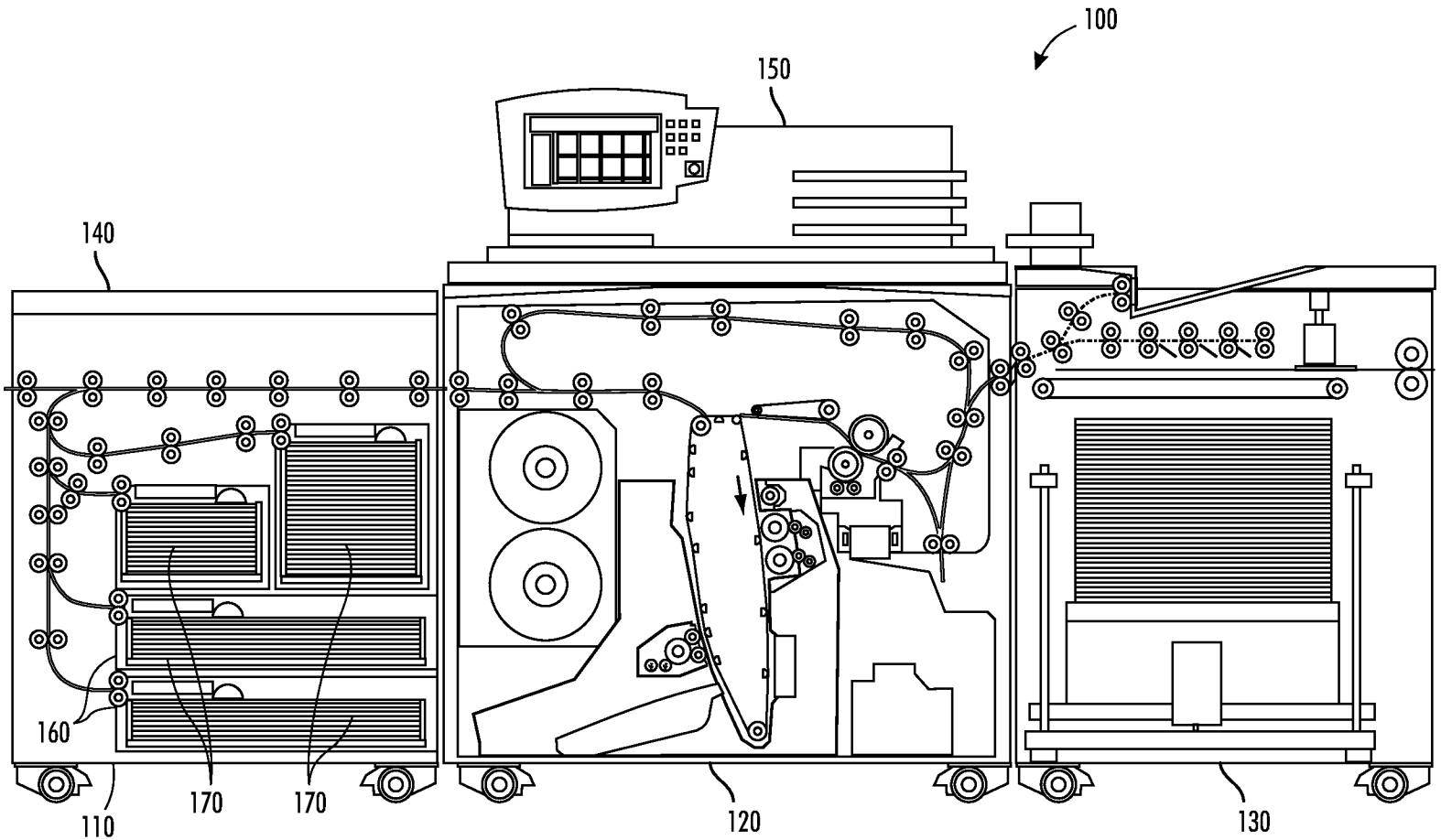
FIG. 1 is an exemplary diagram of an image production device in accordance with one possible embodiment of the disclosure.

Aspects of the embodiments disclosed herein relate to a method for feeding sheets of media from a media stack in an image production device, as well as corresponding apparatus and computer-readable medium.

The disclosed embodiments may include a method for feeding sheets of media from a media stack in an image production device. The method may include fluffing a stack of media with a predetermined amount of air flow, sensing a number of fluffed media sheets in the media stack, determining if the number of fluffed media sheets equals or exceeds a predetermined value, wherein if it is determined that the number of fluffed media sheets equals or exceeds the predetermined value, feeding the fluffed media sheets to an image production section of the image production device.

The disclosed embodiments may further include a fluff management unit for use with an image production device that may include a fluffer that fluffs a stack of media in the image production device with a predetermined amount of air flow, a fluff sensor that senses a number of fluffed media sheets in the media stack, and a fluff controller that determines if the number of fluffed media sheets equals or exceeds a predetermined value, wherein if the fluff controller determines that the number of fluffed media sheets equals or exceeds the predetermined value, the fluff controller feeds the fluffed media sheets to an image production section of the image production device.

The disclosed embodiments may further include a computer-readable medium storing instructions for controlling a computing device for feeding sheets of media from a media stack in an image production device. The instructions may include fluffing a stack of media with a predetermined amount of air flow, sensing a number of fluffed media sheets in the media stack, determining if the number of fluffed media sheets equals or exceeds a predetermined value, wherein if it is determined that the number of fluffed media sheets equals or exceeds the predetermined value, feeding the fluffed media sheets to an image production section of the image production device.

The disclosed embodiments may concern a fluff management unit and process that may be used in conjunction with a vacuum corrugated feeder (VCF). A typical top VCF has four major functional areas. The first function may be handled by the media elevator, which maintains the top of the media stack at a set distance from the bottom of the feedhead. The media fluffing system may then fluff the top several sheets on the stack so that air can readily flow underneath the top sheet as it is acquired by the feedhead. The acquisition function may be handled by the feedhead, with a vacuum system providing the necessary uplift force needed to adhere the top sheet to the feedhead. Finally, the separation function may be enabled both by the feedhead and the air knife.

When the feedhead's corrugation pattern corrugates the top sheet, air gaps may be created between the top sheet and any other acquired sheets. An air knife may then direct air into these gaps, forcing any other acquired sheets back onto the stack. At this point, the sheet may be transported to the first roller pairs in the media path (also known as take-away rolls) via feed belts or a shuttling feedhead, and the sheet enters the media path.

The primary reliability driver for VCFs is the consistency of sheet separation while the top of the stack is being fluffed. If there is good sheet separation at this point, it is very unlikely that a feeder shutdown event (e.g., misfeed, multi-feed, etc.) will occur. If, however, the sheets clump together while being fluffed, the odds of an event occurring increase dramatically. This is especially true of high speed (120 ppm and higher) VCFs, where there is precious little time available for the separation function to compensate for poorly fluffed media.

The VCFs media fluffing system requires a significant amount of development work to reliably fluff all media typically covered in a product specification. This is principally due to the fact that there is no conventional process to monitor the state of the fluffed media stack, and as a result it is necessary to spend several months to two years to refine the fluffer system to assure reliable performance across all required media and environmental conditions.

This disclosure concerns using contact image sensor (CIS) technology (or two-dimensional (2D) sensor array, etc.) to scan the edges of fluffed media sheets in an image production device. In conventional systems, if the performance of the fluffing system is marginal, the sheets may either fluff in clumps of several sheets or not at all. According to the disclosed embodiments, an inexpensive sensor (e.g., a CIS) may be used to detect the number of fluffed media sheets after the one or more media fluffers have been turned on. During the prefeed cycle, the CIS may be used to detect the increase in the number of fluffed media sheets after the media fluffer blowers are turned on. Once the detected number of fluffed media sheets reaches or exceeds a predetermined value, the feeder completes the prefeed cycle and is ready to feed and media sheets may be fed to the image production section of the image production device. During feeder operation, the amount of air supplied to the media fluffers may be adjusted such that the number of fluffed media sheets is kept to a preset range, for example.

FIG. 1 is an exemplary diagram of an image production device 100 in accordance with one possible embodiment of the disclosure. The image production device 100 may be any device or combination of devices that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the image production device 100 is also operable as a copier, the image production device 100 may further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the section may include any number of trays 160, each of which stores a media stack 170 or print sheets ("media") of a predetermined type (size, weight, color, coating, transparency, etc.) and may include a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media may be advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon. Then, the printed sheet is then moved to output section 130, where it may be collated, stapled, folded, punched, etc., with other media sheets in manners familiar in the art.

Figure 2:
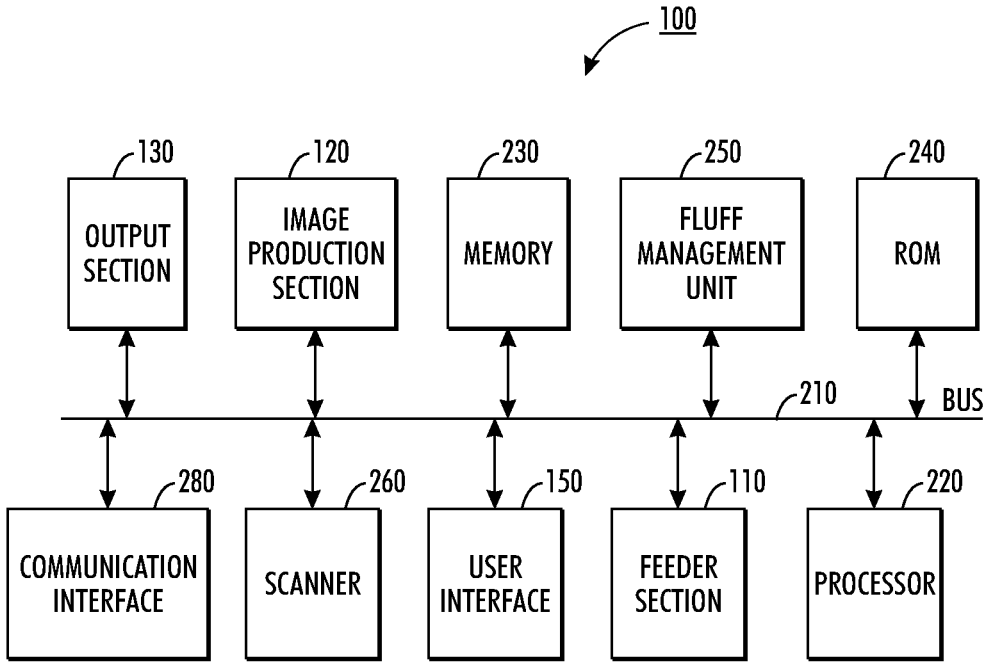
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a fluff management unit 250, a feeder section 110, an output section 130, a user interface 150, a scanner 260, a communication interface 280, and an image production section 120. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example. The scanner 260 may be any device that may scan documents and may create electronic images from the scanned document. The scanner may also scan, recognize, and decode marking-readable codes or markings, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The operation of the fluff management unit 250 will be discussed in relation to the block diagram in FIG. 3 and the flowchart in FIG. 4.

Figure 3:
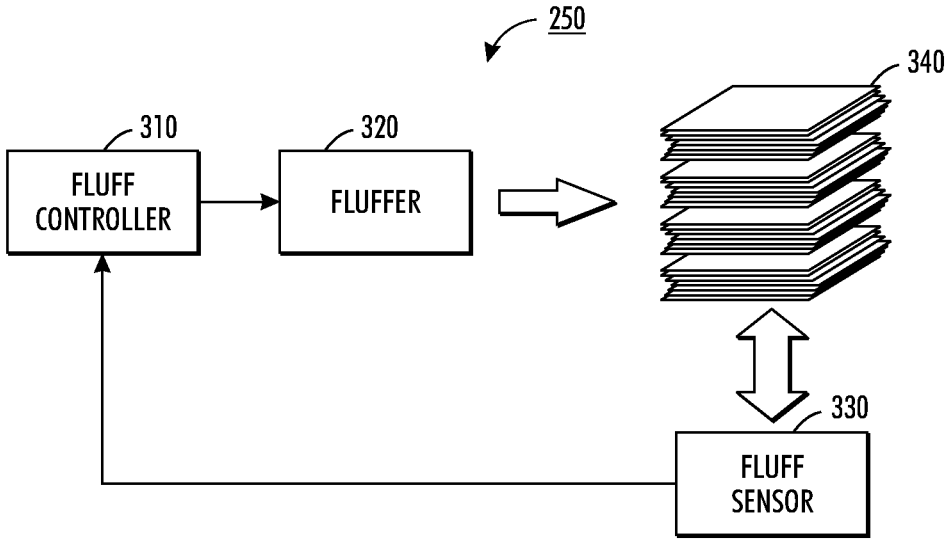
FIG. 3 is an exemplary block diagram of the fluff management unit in accordance with one possible embodiment of the disclosure.

FIG. 3 is an exemplary block diagram of the fluff management unit 250 in accordance with one possible embodiment of the disclosure. The fluff management unit 250 may manage the fluffing of the media stack 170 and may include a fluff controller 310, a fluffer 320, and a fluff sensor 330. The fluff management unit 250 may be integrated into the image production device 100 or be part of a stand-alone feeder section that may be coupled to the image production device 100 while in operation. While the term a media stack 170 is used for ease of discussion, the media stack 170 may represent any type of media used to produce documents in the image production device 100, such as any type of paper, plastic, photo paper, cardboard, etc.

The fluff controller 310 may include at least one conventional processor, microprocessor, logic, etc. that may interpret and execute instructions for controlling the functions of the fluff management unit 250. The functions of the fluff controller 310 may also be performed by the processor 220 of the image production device 100, for example. The fluffer 320 may be any mechanism known to those of skill in the art that may be used to inject air into a media stack 170 in order to provide separation between sheets of media in the stack 170.

The fluff sensor 330 may be a contact image sensor (CIS), or a two-dimensional (2D) sensor array, for example.

Figure 4:
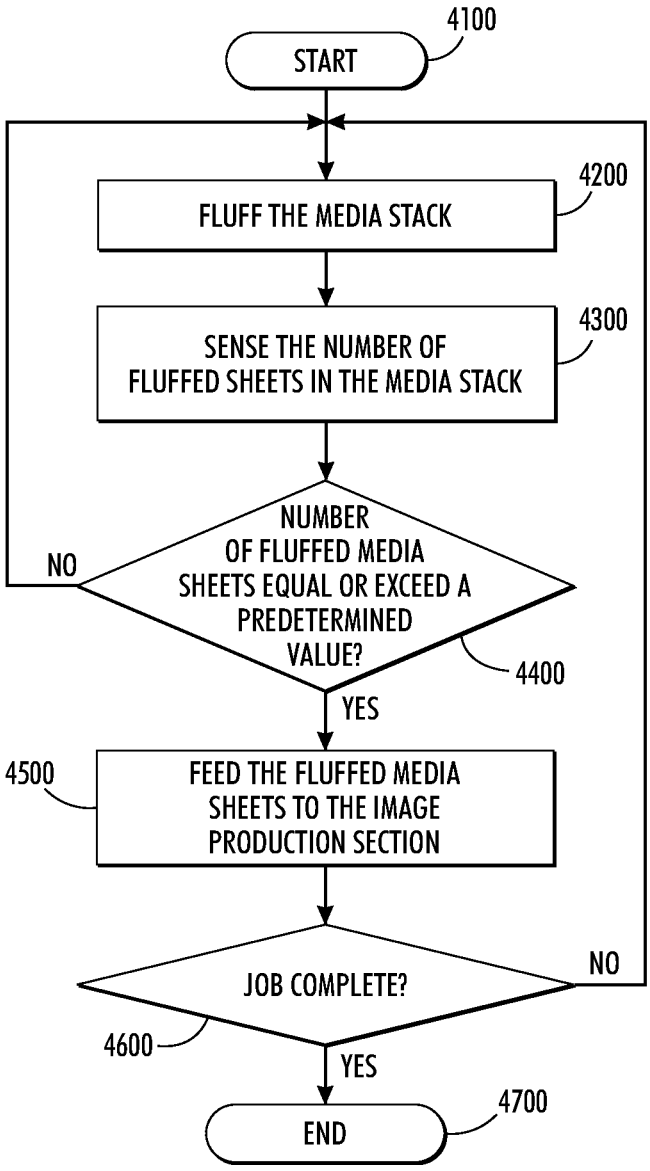
FIG. 4 is a flowchart of an exemplary fluff management process in accordance with one possible embodiment of the disclosure.

FIG. 4 is a flowchart of a fluff management process in accordance with one possible embodiment of the disclosure. The method may begin at step 4100, and may continue to step 4200 where the fluffer 320 may fluff a stack of media 170 in the image production device 100 with a predetermined amount of air flow. At step 4300, the fluff sensor 330 may sense the number of fluffed media sheets in the media stack 170.

At step 4400, the fluff controller 310 may determine if the number of fluffed media sheets equals or exceeds a predetermined value. The predetermined value may depend on media type and media weight, for example, or may be a predetermined range of values, for example. If the fluff controller 310 determines that the number of fluffed media sheets does not equal or exceed the predetermined value, then the process may return to step 4200.

If at step 4400, the fluff controller 310 determines that the number of fluffed media sheets equals or exceeds a predetermined value, then the process goes to step 4500 where the fluff controller 310 feeds the fluffed media sheets to an image production section 120 of the image production device 100. At step 4600, the fluff controller 310 may determine whether the print job is complete. If the fluff controller 310 determines that the print job is not complete, the process returns to step 4200. If the fluff controller 310 determines that the print job is complete, the fluff controller 310 may stop the air flow to the media stack 170 and the process may then go to step 4700 and end.

Note that if the fluff controller 310 determines that the number of fluffed media sheets does not equal or exceed the predetermined value, or falls out of a predetermined range of values before or after fluffing begins, the fluff controller 310 may adjust the air flow used for fluffing the media stack 170. The air flow adjustment may be one of an increase in air pressure or a burst of air, for example.

Figure 5A:
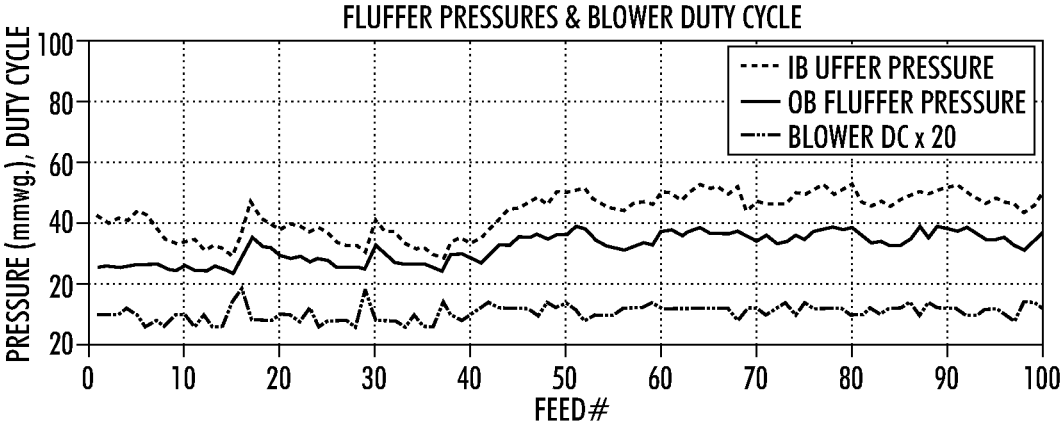
FIGS. 5A and 5B are graphs showing fluffer pressure measurements shown in comparison to the number of fluffed media sheets, respectively, in accordance with one possible embodiment of the disclosure.
Figure 5B:
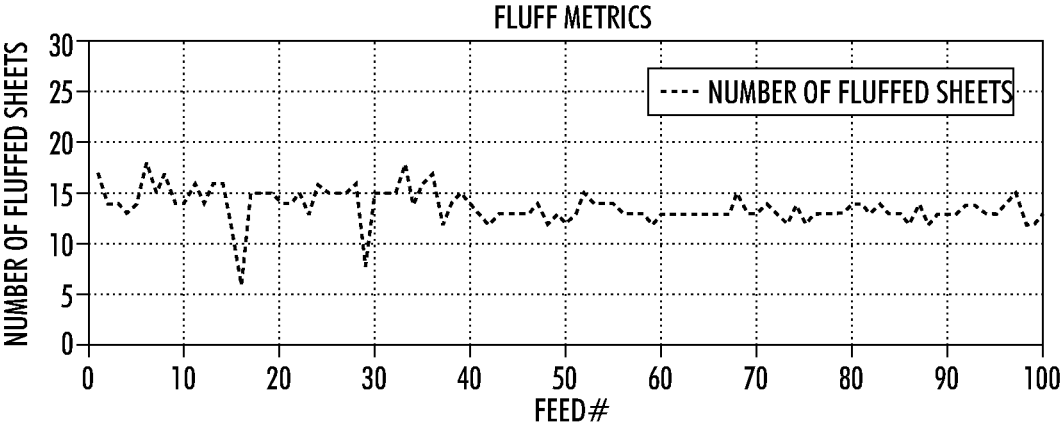

FIGS. 5A and 5B are graphs showing fluffer pressure measurements shown in comparison to the number of fluffed media sheets, respectively, in accordance with one possible embodiment of the disclosure. To check the performance of the fluff management unit 250, a 100 sheet test run was set up such that the first 40 sheets were a lightweight paper (24# bond) followed by 60 sheets of a substantially heavier paper (80# cover). The predetermined value for the number of fluffed media sheets was set at 14. FIGS. 5A and 5B provide the measurements of fluffer pressures and number of fluffed media sheets for this test, and shows where the basis weight transition occurred. From inspection of the pressure data, it can be readily seen that the fluffer controller 310 increased the fluffer pressures to compensate for the heavier weight paper. Some "choppiness" in the number of fluffed media sheets data can also be seen while the lightweight paper is being fed. This is likely due to the predetermined value of 14 being too low for 24# bond, as subsequent testing indicates a higher predetermined value would yield more consistent control.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for feeding sheets of media from a media stack in an image production device, comprising:

fluffing a stack of media with a predetermined amount of air flow;

sensing fluffed media sheets in the media stack to determine a number of fluffed media sheets;

determining if the number of fluffed media sheets equals or exceeds a predetermined value specifying a threshold value for the number of fluffed media sheets; and feeding the fluffed media sheets to an image production section of the image production device, when it is determined that the number of fluffed media sheets equals or exceeds the predetermined value.

2. The method of claim 1, further comprising:

determining if a print job is complete, wherein if the print job is complete, stopping the air flow to the media stack.

3. The method of claim 1, wherein sensing is performed by a contact image Sensor.

4. The method of claim 1, wherein, when it is determined that the number of fluffed media sheets does not equal or exceed the predetermined value, adjusting the air flow used for fluffing the media stack.

5. The method of claim 4, wherein the air flow adjustment is one of an increase in air pressure and a burst of air.

6. The method of claim 1, wherein the predetermined value depends on media type and media weight.

7. The method of claim 1, wherein the image production device is one of a copier, a printer, a facsimile device, and a multi-function device.

8. A fluff management unit for use with an image production device, comprising:

a fluffer that fluffs a stack of media in the image production device with a predetermined amount of air flow;

a fluff sensor that senses fluffed media sheets in the media stack to determine a number of fluffed media sheets; and a fluff controller that determines when the number of fluffed media sheets equals or exceeds a predetermined value, the predetermined value specifying a threshold value for the number of fluffed media sheets, wherein, when the fluff controller determines that the number of fluffed media sheets equals or exceeds the predetermined value, the fluff controller feeds the fluffed media sheets to an image production section of the image production device.

9. The fluff management unit of claim 8, the fluff controller determining when a print job is complete, and stopping the air flow to the media stack based on the determining.

10. The fluff management unit of claim 8, wherein the fluff sensor is a contact image sensor.

11. The fluff management unit of claim 8, wherein when the fluff controller determines that the number of fluffed media sheets does not equal or exceed the predetermined value, the fluff controller adjusts the air flow used for fluffing the media stack.

12. The fluff management unit of claim 11, wherein the air flow adjustment is one of an increase in air pressure and a burst of air.

13. The fluff management unit of claim 8, wherein the predetermined value depends on media type and media weight.

14. The fluff management unit of claim 8, wherein the image production device is one of a copier, a printer, a facsimile device, and a multi-function device.

15. A non-transitory computer-readable medium storing instructions which, when executed by a computing device, causes the computing device to execute a method for feeding sheets of media from a media stack in an image production device, the method comprising:

fluffing a stack of media with a predetermined amount of air flow;

sensing fluffed media sheets in the media stack to determine a number of fluffed media sheets;

determining if the number of fluffed media sheets equals or exceeds a predetermined value specifying a threshold value for the number of fluffed media sheets; and feeding the fluffed media sheets to an image production section of the image production device when it is determined that the number of fluffed media sheets equals or exceeds the predetermined value.

16. The non-transitory computer-readable medium of claim 15, further comprising:

determining if a print job is complete, wherein if the print job is complete, stopping the air flow to the media stack.

17. The non-transitory computer-readable medium of claim 15, wherein sensing is performed by a contact image sensor.

18. The non-transitory computer-readable medium of claim 15, wherein, when it is determined that the number of fluffed media sheets does not equal or exceed the predetermined value, adjusting the air flow used for fluffing the media stack.

19. The non-transitory computer-readable medium of claim 18, wherein the air flow adjustment is one of an increase in air pressure and a burst of air.

20. The non-transitory computer-readable medium of claim 15, wherein the predetermined value depends on media type and media weight.

21. The non-transitory computer-readable medium of claim 15, wherein the image production device is one of a copier, a printer, a facsimile device, and a multi-function device.

* * * * *